US007325787B1

(12) United States Patent
Gibbs

(10) Patent No.: US 7,325,787 B1
(45) Date of Patent: Feb. 5, 2008

(54) BARRIER

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 0 days.

(21) Appl. No.: 11/163,653

(22) Filed: Oct. 26, 2005

Related U.S. Application Data

(60) Provisional application No. 60/522,724, filed on Nov. 1, 2004.

(51) Int. Cl.
*E04H 17/00* (2006.01)
*E04H 17/04* (2006.01)

(52) U.S. Cl. ..... 256/11; 256/12; 256/2

(58) Field of Classification Search ..... 256/2–9, 256/11, 12
See application file for complete search history.

(56) References Cited

U.S. PATENT DOCUMENTS

| | | | | |
|---|---|---|---|---|
| 2,541,388 A | | 2/1951 | Swanson | 256/8 |
| 2,908,132 A | | 10/1959 | Klemm | 57/1 R |
| 2,908,484 A | | 10/1959 | Uhl | 256/8 |
| 2,940,732 A | | 6/1960 | MaChesney et al. | 256/8 |
| 3,010,701 A | | 11/1961 | Klemm | 256/8 |
| 3,224,736 A | | 12/1965 | Musgrave | 256/8 |
| 3,455,539 A | | 7/1969 | Loofbourrow | 256/8 |
| 3,463,455 A | | 8/1969 | Meckel | 256/8 |
| 3,480,256 A | | 11/1969 | Simon et al. | 256/8 |
| 3,916,958 A | | 11/1975 | Uhl | 140/4 |
| 3,990,485 A | | 11/1976 | Uhl | 140/58 |
| 4,028,925 A | | 6/1977 | Mainiero | 72/294 |
| 4,040,603 A | | 8/1977 | Mainiero | 256/8 |
| RE30,814 E | | 12/1981 | Mainiero | 72/294 |
| 4,328,955 A | | 5/1982 | Hermans | 256/8 |
| 4,484,729 A | | 11/1984 | Mainiero et al. | 256/1 |
| 4,503,423 A | | 3/1985 | Mainiero et al. | 340/552 |
| 4,509,726 A | | 4/1985 | Boggs et al. | 256/8 |
| 4,525,701 A | * | 6/1985 | Leih | 340/541 |
| 4,571,578 A | * | 2/1986 | Karas | 342/27 |
| 4,666,129 A | | 5/1987 | Dobson | 256/2 |
| 4,718,641 A | | 1/1988 | Mainiero | 256/8 |
| 4,784,373 A | | 11/1988 | Mainiero | 256/8 |
| 4,818,972 A | | 4/1989 | Mainiero et al. | 340/566 |
| 4,833,904 A | | 5/1989 | Mainiero | 72/11.2 |
| 4,844,422 A | | 7/1989 | Major | 256/8 |
| 4,884,425 A | | 12/1989 | Mainiero | 72/8.3 |
| 4,887,796 A | | 12/1989 | Cano et al. | 256/8 |
| 4,906,975 A | | 3/1990 | Casella et al. | 340/566 |
| 4,915,359 A | | 4/1990 | Cochrane | 256/10 |
| 4,920,331 A | * | 4/1990 | Ver Loren van Themaat et al. | 340/541 |
| 4,920,775 A | | 5/1990 | Mainiero | 72/17.3 |
| 4,978,943 A | | 12/1990 | Mainiero et al. | 340/566 |

(Continued)

*Primary Examiner*—Robert J. Sandy
*Assistant Examiner*—Joshua T. Kennedy
(74) *Attorney, Agent, or Firm*—Gary Peterson

(57) ABSTRACT

A barrier formed from one or more barrier tapes, which may be barbed. Two lower barrier tapes are supported on the opposed projecting arms of outrigger system installed atop a structure such as a wall, gate or fence. Each extended lower barrier tape is formed from loops having a substantially elliptical shape, with a major axis which extends parallel to the outrigger arm supporting it, with a length substantially equal thereto. The ratio of major axis length to minor axis length in each loop is between about 2 and about 5. A third and upper barrier tape, formed from loops with a circular shape, is positioned between the two lower barrier tapes, in at least partially overlying relationship to the lower barrier tapes.

30 Claims, 5 Drawing Sheets

U.S. PATENT DOCUMENTS

| | | | | |
|---|---|---|---|---|
| 5,062,612 | A | 11/1991 | Mincher | 256/11 |
| 5,072,980 | A | 12/1991 | Mainiero | 294/15 |
| 5,074,529 | A | 12/1991 | Mainiero et al. | 256/8 |
| 5,109,583 | A | 5/1992 | Pavlov | 29/7.1 |
| 5,139,234 | A | 8/1992 | Cochrane | 256/8 |
| D336,427 | S | 6/1993 | Mainiero | D9/423 |
| 5,401,002 | A | 3/1995 | Major | 256/2 |
| 5,530,430 | A | 6/1996 | Pavlov | 340/566 |
| D429,342 | S * | 8/2000 | Binns | D25/46 |
| 6,601,830 | B1 | 8/2003 | Pavlov | 256/8 |
| 2006/0022184 | A1 * | 2/2006 | Pavlov | 256/2 |
| 2006/0214148 | A1 * | 9/2006 | Major et al. | 256/8 |

* cited by examiner

BARRIER

CROSS-REFERENCE TO RELATED APPLICATION

This application claims the benefit of the filing date of U.S. Provisional Patent Application Ser. No. 60/522,724, filed Nov. 1, 2004, the entire disclosure of which is incorporated by reference.

FIELD OF THE INVENTION

The present invention relates generally to barriers, and more particularly to barriers using barbs to impede and deter intrusion.

BRIEF DESCRIPTION OF THE DRAWINGS

FIG. 2 is a side cross-sectional view of the barrier shown in FIG. 1.

FIG. 5 is a bottom view of the outrigger shown in FIG. 4, taken along line 5-5.

FIG. 6 is an elevational view the outrigger shown in FIG. 4, in an installed position on a post.

DETAILED DESCRIPTION

Figure 1:
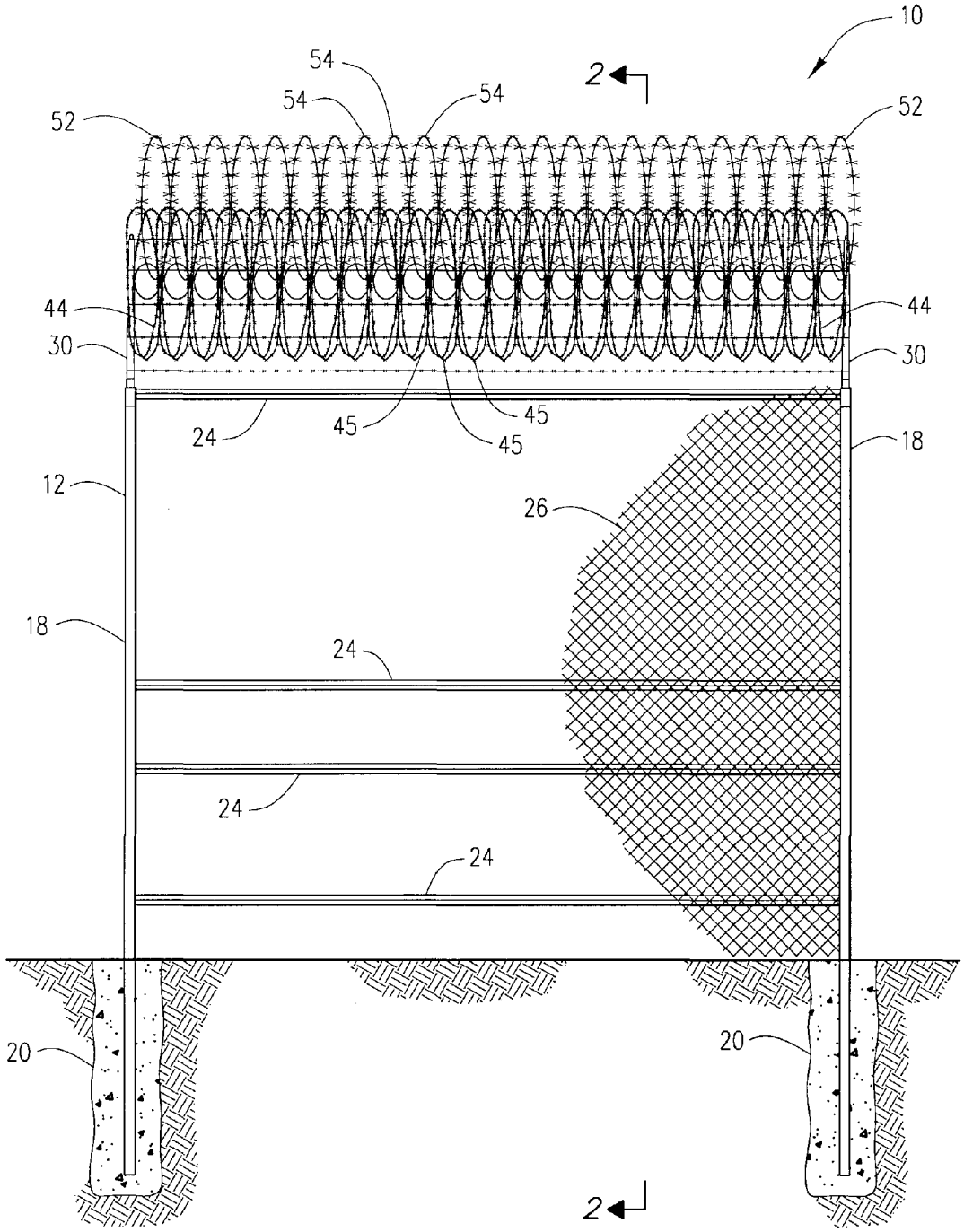
FIG. 1 is a front elevational view of a section of the barrier of the present invention. The ground and substrates are shown in cross-section. The metal mesh has been partially cut away, to be better display other components.
Figure 3:
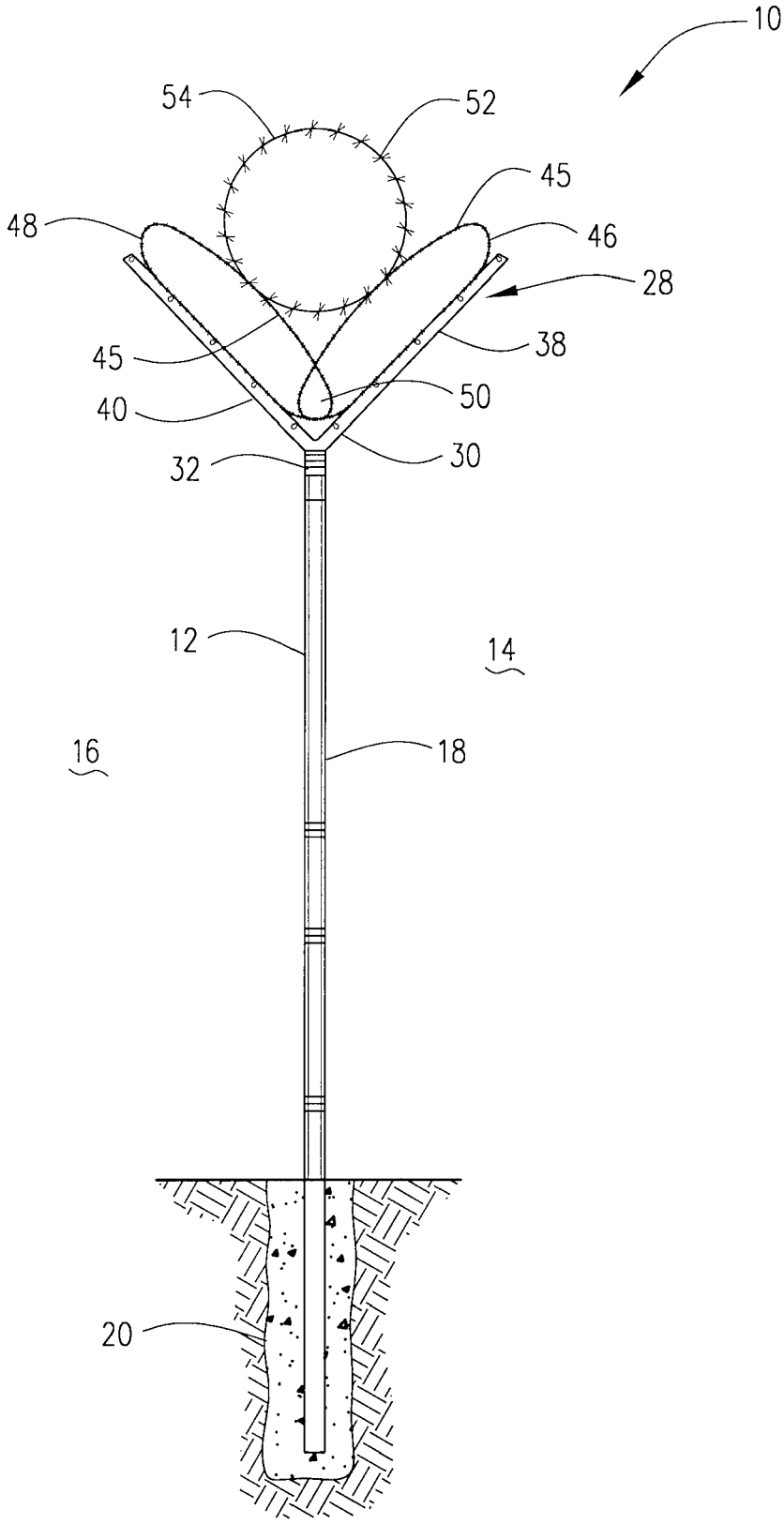
FIG. 3 is a partial view of a post used to form the barrier of the present invention, showing the upper portion thereof.
Figure 3:
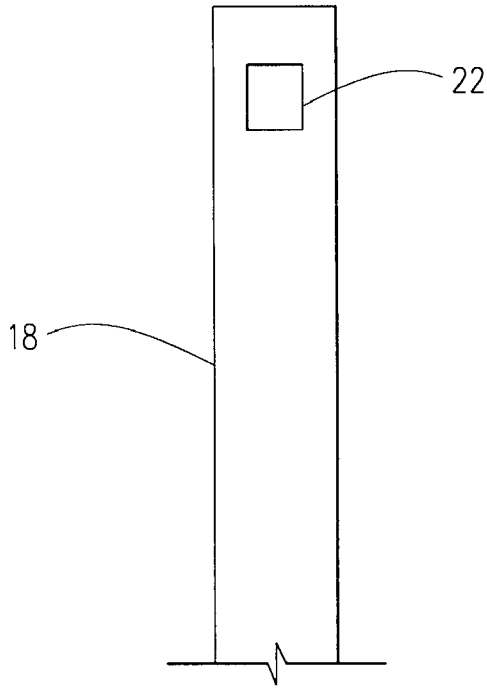

As shown in FIGS. 1, 2 and 3, the present invention comprises a high security barrier 10. The barrier 10 preferably comprises a structure 12, such as a fence, gate or wall, characterized by a first side 14 and an opposed second side. In the embodiment shown in FIGS. 1 and 2, the structure 12 comprises a fence.

When the structure 12 comprises a fence, it is preferably formed from a plurality of spaced vertical posts 18, preferably identical in construction, each of which is securely anchored at its base into a substrate 20, such as an underground mass of concrete. The posts are preferably formed from a strong and durable material, such as steel. The posts 18 are situated along the boundary of the area to be enclosed by the barrier 10, with a post spacing adequate to impart strength to the barrier 10 and to securely anchor other barrier components. In one preferred embodiment, adjacent posts 18 are separated by a distance of between about 8 and 10 feet.

The aboveground height of each post 18, in its installed configuration, is preferably substantially in excess of the height of a human or other intruder. In one preferred embodiment, the aboveground height of each post 18 is at least 8 feet. Adjacent its upper end, each post 18 is preferably penetrated by a plurality of vertically spaced passageways 22, one of which is shown in FIG. 3.

With reference to FIGS. 1 and 2, the barrier 10 further comprises a plurality of elongate rails 24, preferably of identical construction. The rails are preferably formed from a strong and durable material, such as steel. The rails 24 may be channel-shaped, or may have a tubular construction. If tubular, the rails 24 my have a rectangular or circular cross-section. Each rail 24 is preferably formed from a plurality of collinear sections, with swaging used to interconnect adjacent sections to form a continuous rail 24. The length of each section preferably exceeds the spacing of the posts 18. For example, when the spacing of adjacent posts 18 is 10 feet, the length of a section of rail 24 might be 21 feet. At its opposite ends, each rail 24 is secured to an end post (not shown) by a bracket (nor shown) or other connector.

The barrier 10 is preferably provided with at least two, and more preferably three or more rails 24, extending in parallel relationship. In the embodiment shown in the Figures, the barrier 10 is formed from four parallel rails 24. Each rail 24 is supported along its length by posts 18 situated intermediate to the end posts. Preferably, each rail 24 extends through a corresponding the passageway 22 formed in each of these posts 18. Each passageway 22 should be sized to closely but clearingly receive a rail 24, and situated at the same vertical height on post 18 as the rail 24 with which it registers.

As shown in FIG. 1, the barrier 10 preferably further comprises a woven wire mesh 26, preferably having a diamond pattern, which is supported on the plural rails 24, and secured thereto each of the rails 24, and preferably each of the posts 18, by fasteners (not shown), such as wire ties. Preferably, the mesh 26 is formed from a strong and durable material, such as steel. The mesh 26 is preferably sized so as to covers substantially the entire region between adjacent posts, from immediately adjacent the ground to a position adjacent the upper end of the posts.

Alternatively, the barrier may be provided with a plurality of upright members, such as pickets, extending in parallel relationship to the posts, and preferably vertically. The separation distance between adjacent upright members, and between each post and its adjacent upright member, should be sufficiently small to prevent an intruder from traversing the gap. A typical separation distance might be 6 inches or less. The vertical height of each upright member is preferably approximately equal to the vertical height of the posts.

The barrier 10 preferably further comprises an outrigger system 28 supported by the structure 12 and comprising a plurality of spaced outriggers 30. When the structure 12 comprises a fence, the outriggers 30 are preferably provided in a number equal to the number of posts 18, with each post 18 provided with an outrigger 30.

Figure 4:
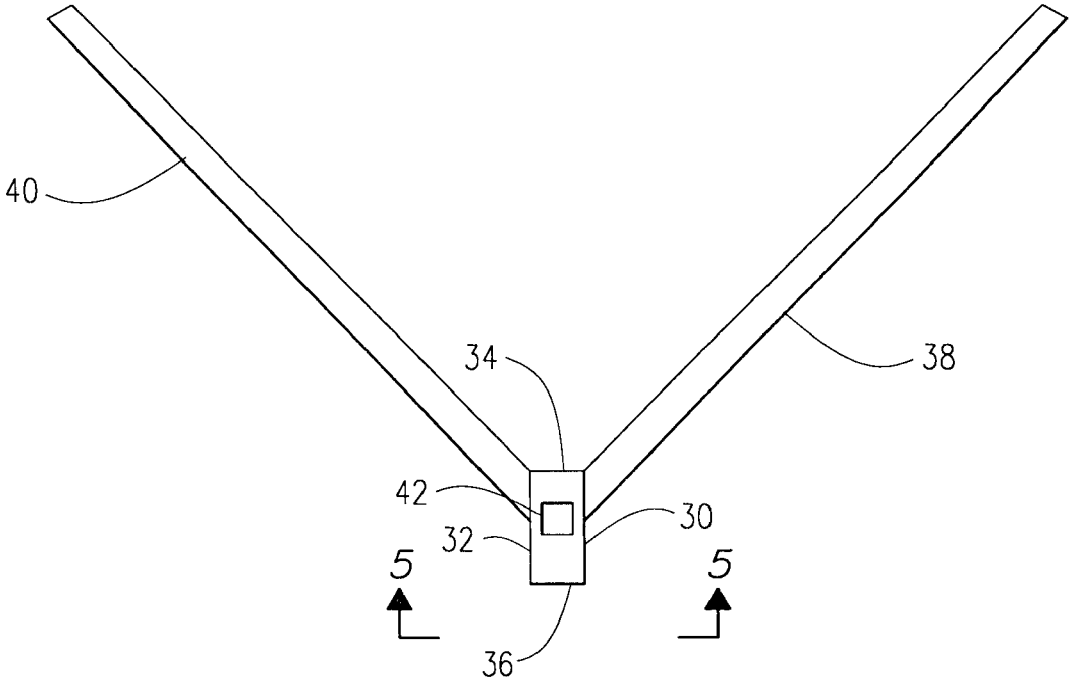
FIG. 4 is an elevational view of the outrigger used to form the barrier of the present invention.
Figure 3:
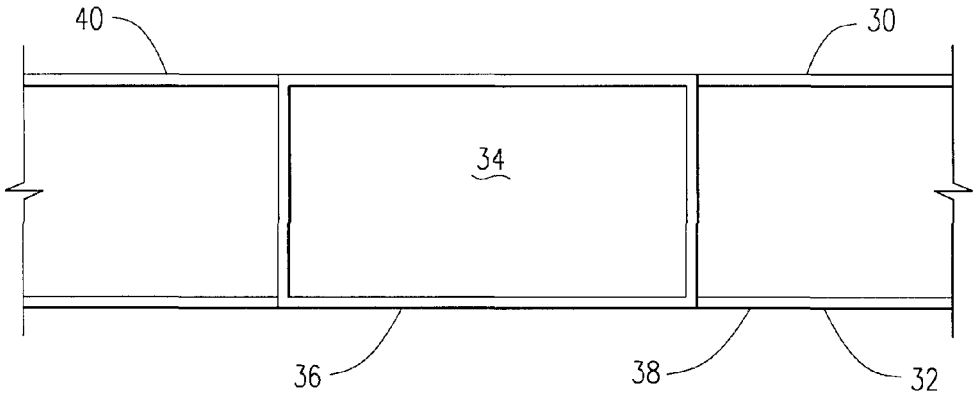
Figure 4:
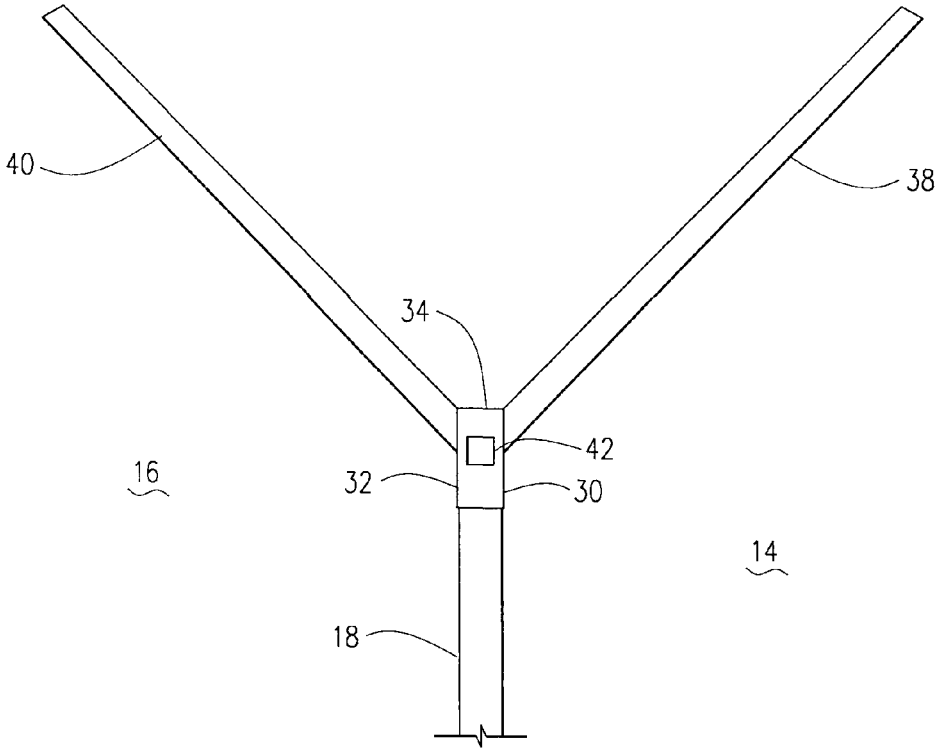

As best shown in FIG. 4, each outrigger 30 preferably comprises a base 32, which preferably comprises a box-like structure with a closed upper end 34 and an open lower 36. The base 32 is preferably sized so that the upper end of a post 18 may be closely but clearingly received within the base 32 at its lower end 36, as shown in FIG. 6. In an installed position of the outrigger 30, the closed upper end 34 of the base 32 should be flush with the upper end of the post 18. The outriggers 30 are preferably formed from the same material as the rails 24.

As shown in FIGS. 4-6, a first arm 38 extends from one side of the base 32, and a second arm 40 extends from the opposite side of the base 32. The first and second arms 38 and 40 are coplanar, and each extend from a side position on the base 32 intermediate the upper and lower ends 34 and 36. As shown in FIG. 5, each of the arms 38 and 40 preferably comprises a channel-shaped member opening in the same direction as the lower end 36 of base 32.

Preferably, each of the two sides of base 32 from which the arms 38 and 40 do not extend is provided with an opening 42. Each opening 42 should be sized to closely but clearingly receive the upper rail 24 therethrough, with the openings 42 situated so that they register with the passageway 22 of the post 18 in the installed position of the outrigger 30. This configuration permits extension of the upper rail 24 of the barrier 10 through the registering passageway 22 and openings 42, so as to securely lock each outrigger 30 in an installed position atop a corresponding post 18.

In an alternative embodiment, not shown in the Figures, the base 32 is secured to each post by welding or by connectors, such as bolts. In such an embodiment, the upper rail 24 passes through a passageway 22 situated below the end of the base when outrigger is in an installed position on the post. The base of the outrigger need not be provided with openings through which the rail may be received in such an embodiment.

In its installed position, shown in FIGS. 2 and 6, the first arm 38 of each outrigger 30 projects toward the first side 14 of structure 12, while the second arm 40 of each outrigger 30 projects toward the second side 16 of structure 12. Each of the arms 38 and 40 preferably extends at an angle of between about 30 degrees and about 60 degrees to vertical. More preferably, each arm 30 extends at a 45 degree angle to vertical. The length of each arm 30 is preferably substantially equal to, or exceeds, the reach of the typical adult human arm. Such length and angling of the arms 38 and 40 renders it difficult for a human intruder, after gaining a foothold in the upper portion of the mesh 26, to swing over either an outrigger 30 or the coiled barrier tapes supported by the outriggers 30. In preferred embodiments, the arms 38 and 40 have a length of 30 inches, 36 inches, or more. One especially preferred length for arms 38 and 40 is 36 inches.

As best shown in FIGS. 1 and 2, the barrier 10 further comprises at least one, and preferably a plurality of elongate lower barrier tapes 44, which function to obstruct and deter access in the area above the structure 12. Each lower barrier tape 44 extends along the barrier 10 in generally overlying relationship to the structure 12 preferably along all or a substantial portion of its length. When the structure 12 comprises a fence or gate, the lower barrier tapes 44 extends in overlying relationship to its upper rail 24.

Each lower barrier tape 44 is supported by the outriggers 30 and preferably extends within the general area between the arms 38 and 40 of the outriggers 30. In the preferred embodiment shown in the Figures, the lower barrier tapes 44 preferably comprise a first barrier tape 46 and a second barrier tape 48, best shown in FIG. 2. Preferably, the first barrier tape 46 is supported by the first arms 38 of the outrigger system 28 and is situated adjacent the first side 14 of structure 12, while the second barrier tape 48 is supported by the second arms 40 of the outrigger system 28, and is situated adjacent the second side 16 of structure 12. Each lower barrier tape 44 is secured to the outriggers 30 which it traverses, preferably by wire ties (not shown).

Each lower barrier tape 44 is preferably characterized by a coiled configuration. More preferably, each lower barrier tape 44 is preferably characterized by a plurality of loops 45, each such loop having a substantially elliptical shape when viewed along the axis of extension of the tape 44, as shown in FIG. 2. This axis of extension may comprise a straight, curved, or other line, and should generally coincide with, or extend in parallel relation to, the longitudinal path of the structure 12. In the planar barrier 10 shown in the Figures, the axis of extension comprises a straight line.

In an installed configuration, best shown in FIG. 2, the major axis of the ellipse defined by each loop 45 of each lower barrier tape 44 preferably extends in generally parallel relationship to the arms of the outriggers 30 which support that tape. Thus, in the embodiment shown in the Figures, the major axis of the ellipse defined by each loop of the first barrier tape 46 extends in generally parallel relationship to the first arms 40 of the outrigger system 28, while the major axis of the ellipse defined by each loop of the second barrier tape 48 extends in generally parallel relationship to the second arms 42. Preferably, the shapes defined by the loops of 45 the first and second barrier tapes 46 and 48 overlap at an area 50 at the lower ends of the respective loops. At these areas of overlap 50, respective loops of the second barrier tape 48 are preferably interstitially positioned between adjacent loops of the first barrier tape 46.

As shown in FIG. 2, the length of the major axis of the ellipse defined by each loop 45 is preferably substantially equal to the length of the arms 38. The ratio of the length of the major axis to that of the minor axis of this ellipse is preferably between about 2 and about 5. In one such embodiment, the ratio of the major axis length to minor axis length is between about 2 and about 3. Such an embodiment might feature loops characterized by a minor axis of about 12 inches, and a major axis length of about 24, 30 or 36 inches. In another embodiment, the ratio of the major axis length to minor axis length is between about 3 and about 5, and more preferably about 4. Such an embodiment might feature loops characterized by a minor axis of about 9 inches, and a major axis length of about 27, 36 or 45 inches. This sizing and shaping of the loops 45 allows each lower barrier tape 44 to be fitted closely and securely to the arms of the outrigger system 28 that support it, thereby enhancing the ability of the projecting arms to obstruct and deter intrusion.

With continued reference to FIGS. 1 and 2, the barrier 10 preferably further comprises an upper barrier tape 54, which cooperates with the lower barrier tape 44 to obstruct and deter access in the area above the structure 12. The upper barrier tape 54 extends along the barrier 10 in generally overlying relationship to the structure 12, preferably along all or a substantial portion of its length. The upper barrier tape 54 extends within the general area between the arms 30 of the outriggers 30, between the first and second barrier tapes 44 and 46, in at least partially overlying relationship thereto.

Each upper barrier tape 54 is preferably characterized by a coiled configuration. More preferably, the upper barrier tape 54 preferably comprises a third barrier tape, characterized by a plurality of loops 54, each such loop having a substantially circular shape when viewed along the axis of extension of the tape 54, as shown in FIG. 2. This circular shape facilitates placement of the coiled upper barrier tape 54 between the lower barrier tapes 44. The upper barrier tape 54 is secured at spaced locations therealong to the lower barrier tapes 44, preferably by wire ties (not shown).

Figure 7:
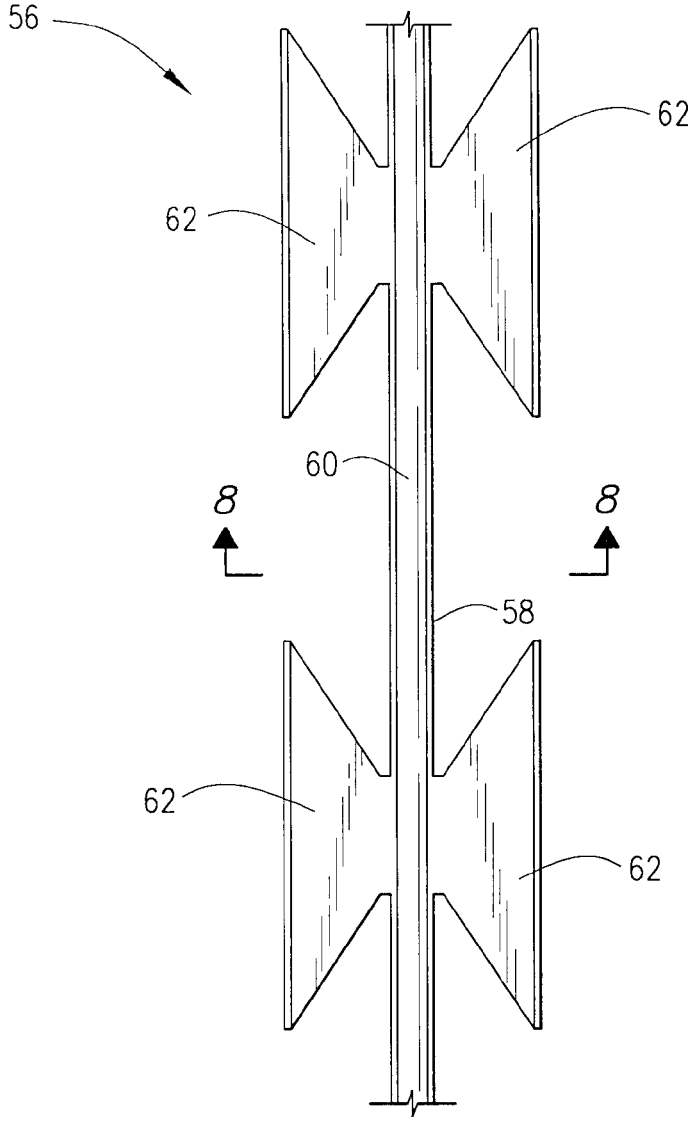
FIG. 7 is a plan view of a barbed tape used in the barrier of the present invention.

The lower and upper barrier tapes 44 and 54 may comprise barbed wire, barbed tape, or any other flexible elongate barrier material that can obstruct and deter an intruder. One preferred barrier material is the steel barbed tape 56 shown in FIGS. 7 and 8. The barbed tape 56 preferably comprises an elongate channel-shaped member 58 within which a central reinforcing wire 60 is received. The channel-shaped member 58 is pinched or crimped, preferably along its entire length, so as to hold the reinforcing wire 60 in place within the channel-shaped member 58.

Figure 8:
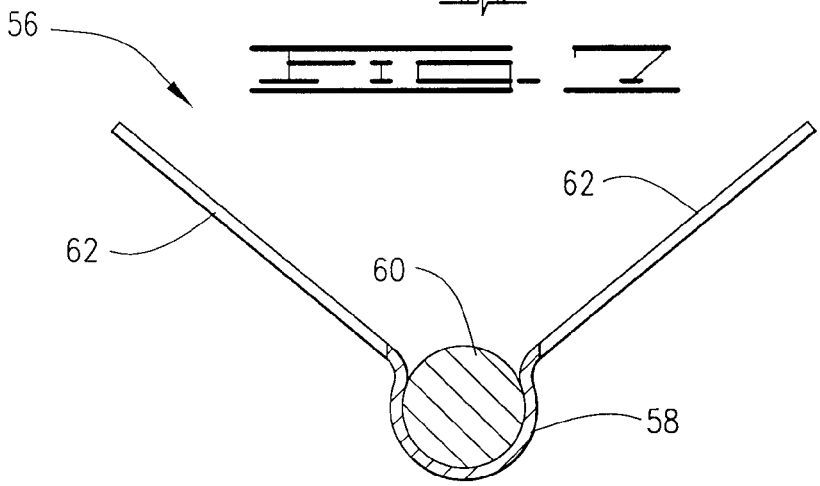
FIG. 8 is a cross-sectional view of the barbed tape shown in FIG. 7, taken along line 8-8.

The barbed tape 56 preferably further comprises a plurality of sharpened barbs 62, which project from each side wall of the channel-shaped member 58. Preferably the barbs 62 are formed in clusters, with pairs of barbs 62 situated on immediately opposite sides of the channel-shaped member 58. As shown in FIG. 8, opposed pairs of barbs 62 are preferably characterized by an included angle of more than 90 degrees, and less than 180 degrees. The barbs 62 are preferably stamped from a flat sheet of material, prior to shaping of the material into the channel-shaped member 58.

The barrier 10 of the present invention may be assembled and by use of a barrier system that may be installed on a structure 12. The barrier system comprises at least one, and preferably two or more lower barrier tapes 44, and preferably at least one upper barrier tape 54. The barrier system further comprises the outrigger system 28. Components of the barrier system may be advantageously furnished in the form of a kit comprising the requisite barrier tapes, a plurality of outriggers 30, any hardware such needed to secure the outriggers 30 to structure 12, and hardware, such as wire ties, needed to secure the barrier tapes to the outriggers 30.

Changes may be made in the construction, operation and arrangement of the various parts, elements, steps and procedures described herein without departing from the spirit and scope of the invention as described in the following claims.

What is claimed is:

1. A barrier, comprising:

a structure having first and second sides and further comprising: an outrigger system supported by the structure, said outrigger system comprising a plurality of spaced first arms projecting toward the first side of the structure and a plurality of spaced second arms projecting toward the second side of the structure; a first barrier tape positioned on the structure, the first barrier tape characterized by a plurality of loops, each such loop having a substantially elliptical shape and a major axis length exceeding minor axis length; and a second barrier tape positioned on the structure, the second barrier tape characterized by a plurality of loops, each such loop having a substantially elliptical shape and a major axis length exceeding minor axis length; in which the shapes of the loops of the first and second barrier tapes overlap at the lower ends of their respective loops, in which a loop of the second barrier tape is interstitially positioned between adjacent loops of the first barrier tape in the area of overlapping shapes, and in which the first barrier tape is supported by the first arms, and in which the second barrier tape is supported by the second arms.

2. The barrier of claim 1, further comprising:

a third barrier tape situated in at least partially overlying relationship to the first and second barrier tapes.

3. The barrier of claim 2 in which the third barrier tape is characterized by a plurality of loops, each such loop having a substantially circular shape.

4. The barrier of claim 1 in which the ratio of the major axis length to minor axis length is between about 2 and about 5.

5. The barrier of claim 1 in which the ratio of the major axis length to minor axis length is between about 2 and about 3.

6. The barrier of claim 1 in which the ratio of the major axis length to minor axis length is between about 3 and about 5.

7. The barrier of claim 1 in which the ratio of the major axis length to minor axis length is about 4.

8. The barrier of claim 1 in which the first barrier tape is barbed.

9. The barrier of claim 1 in which the structure comprises a fence or gate.

10. The barrier of claim 1 in which the structure is characterized as having and upper and lower ends, in which the first arms are supported by the structure at its upper end, and in which the first arms project outside the footprint of the structure.

11. The barrier of claim 1 in barrier tape is characterized as extending above ground level.

12. The barrier of claim 1 in which the sides of a plurality of loops of the first barrier tape engage the first arms, with each such loop contacting a first arm along substantially all of the first arm's length.

13. The barrier of claim 12 in which the barrier tape is characterized as untrussed.

14. The barrier of claim 1 in which the barrier tape is characterized as untrussed.

15. A barrier system positionable on a structure having opposed first and second sides, comprising:

an outrigger system supportable by the structure, comprising:

a plurality of spaced first arms projectable toward the first side of the structure; and a plurality of spaced second arms projectable toward the second side of the structure;

a first barrier tape supportable by the first arms, the first barrier tape characterized a plurality of loops, each such loop having a substantially elliptical shape with a major axis length exceeding minor axis length; and a second barrier tape supportable by the second arms, the second barrier tape characterized by a plurality of loops, each such loop having a substantially elliptical shape with a major axis length exceeding minor axis length; in which the shapes of the loops of the first and second barrier tapes overlap at the lower ends of their respective loops, and in which a loop of the second barrier tape is interstitially positioned between adjacent loops of the first barrier tape in the area of overlapping shapes.

16. The barrier system of claim 15, further comprising:

a third barrier tape positionable in at least partially overlying relationship to the first and second barrier tapes.

17. The barrier system of claim 16 in which the third barrier tape is characterized by a plurality of loops, each such loop having a substantially circular shape.

18. The barrier system of claim 15 in which the ratio of the major axis length to minor axis length is between about 2 and about 5.

19. The barrier system of claim 15 in which the ratio of the major axis length to minor axis length is between about 2 and about 3.

20. The barrier system of claim 15 in which the ratio of the major axis length to minor axis length is between about 3 and about 5.

21. The barrier system of claim 15 in which the ratio of the major axis length to minor axis length is about 4.

22. The barrier system of claim 15 in which the length of the major axis of a loop is substantially equal to the length of the arm that supports it.

23. The barrier system of claim 22 in which the major axis of a loop is positioned in substantially parallel relationship to the arm that supports it.

24. The barrier system of claim 23 in which the ratio of the major axis length to minor axis length is between about 3 and about 5.

25. The barrier system of claim 23 in which the ratio of the major axis length to minor axis length is about 4.

26. The barrier system of claim 15 in which the major axis of a loop is positioned in substantially parallel relationship to the arm that supports it.

27. The barrier tape of claim 26 in which the ratio of the major axis length to minor axis length is between about 3 and about 5.

28. The barrier tape of claim 26 in which the ratio of the major axis length to minor axis length is about 4.

29. The barrier system of claim 15 in which the first barrier tape is barbed.

30. The barrier system of claim 15 in which the barrier tape is characterized as untrussed.

* * * * *